US005311966A

United States Patent [19]

Daniels

[11] Patent Number: 5,311,966

[45] Date of Patent: May 17, 1994

[54] SCAFFOLD SYSTEM

[75] Inventor: Benjamin E. Daniels, Hallsville, Tex.

[73] Assignee: GLNX Corporation, The Woodlands, Tex.

[21] Appl. No.: 753,210

[22] Filed: Aug. 30, 1991

[51] Int. Cl.[5] ..... E04G 1/36

[52] U.S. Cl. ..... 182/128; 182/150

[58] Field of Search ..... 182/128, 117-118, 182/150

[56] References Cited

U.S. PATENT DOCUMENTS

| | | | |
|---|---|---|---|
| 1,334,622 | 3/1920 | McLeod . | |
| 1,409,559 | 3/1922 | McLeod . | |
| 2,346,033 | 4/1944 | Jordan | 182/128 |
| 2,415,658 | 2/1947 | Rusk . | |
| 3,166,154 | 1/1965 | Titzel . | |
| 3,183,997 | 5/1965 | Kleiss | 182/150 X |
| 3,306,396 | 2/1967 | Goss | 182/128 |
| 3,454,133 | 7/1969 | Gregord | 182/128 |
| 3,556,252 | 1/1971 | Atkins | 182/128 |
| 3,854,550 | 12/1974 | Shingler | 182/118 |
| 3,994,365 | 11/1976 | Petermann et al. | 182/2 |
| 4,074,792 | 2/1978 | Zaugg et al. | 182/150 |
| 4,671,382 | 6/1987 | D'Alessio | 182/128 |
| 4,892,170 | 1/1990 | O'Donnell | 182/100 |

*Primary Examiner*—Alvin C. Chin-Shue
*Attorney, Agent, or Firm*—Ned Conley; Donald J. Verplancken

[57] ABSTRACT

A scaffold for locating workmen and materials inside a railroad car includes a pair of ladders hanging from the roof of the cars through apertures therein, and a plurality of planks disposed across the gap between the ladders and supported at their ends by the ladders.

16 Claims, 6 Drawing Sheets

FIG. 6
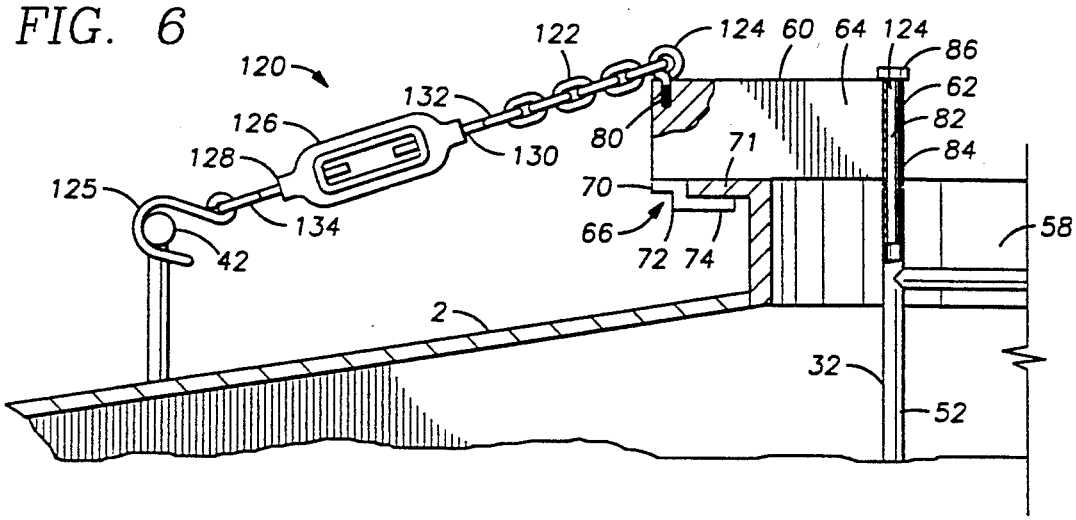
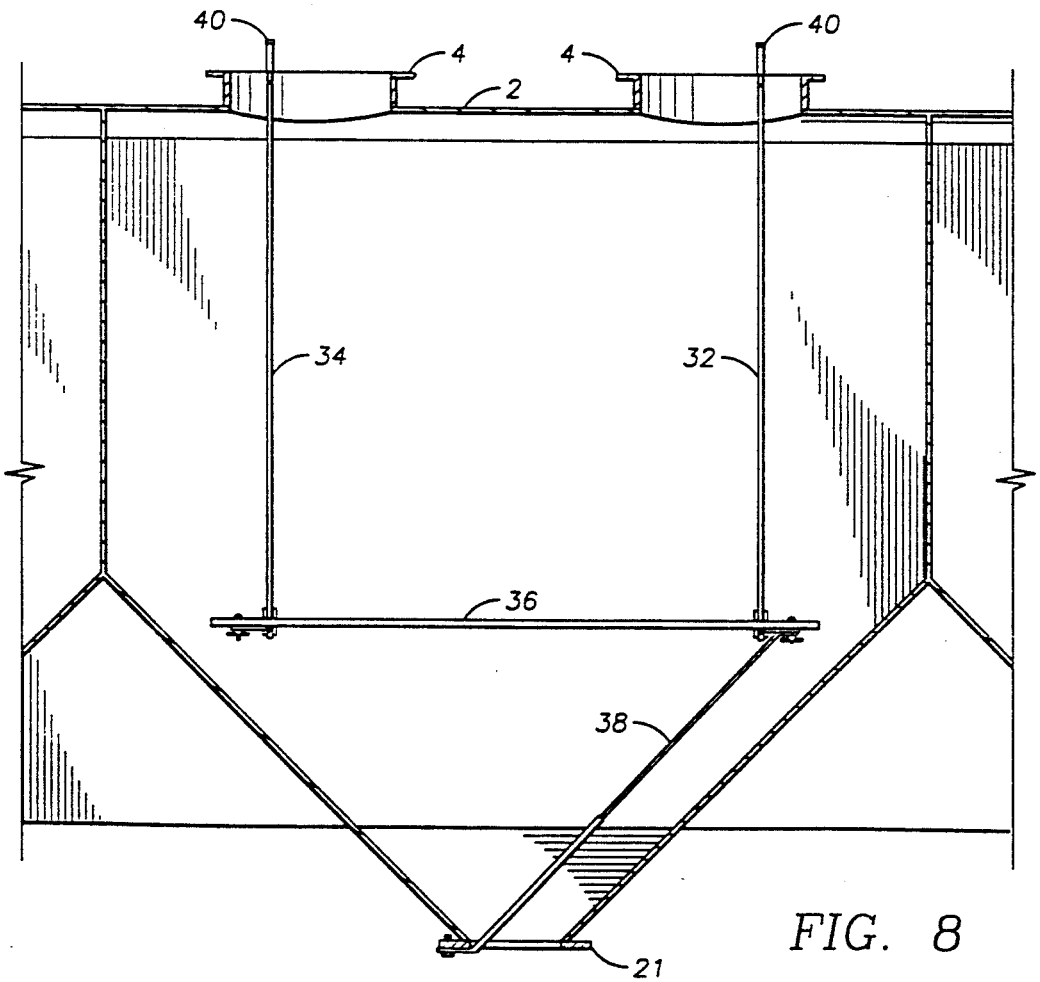
FIG. 8

FIG. 9
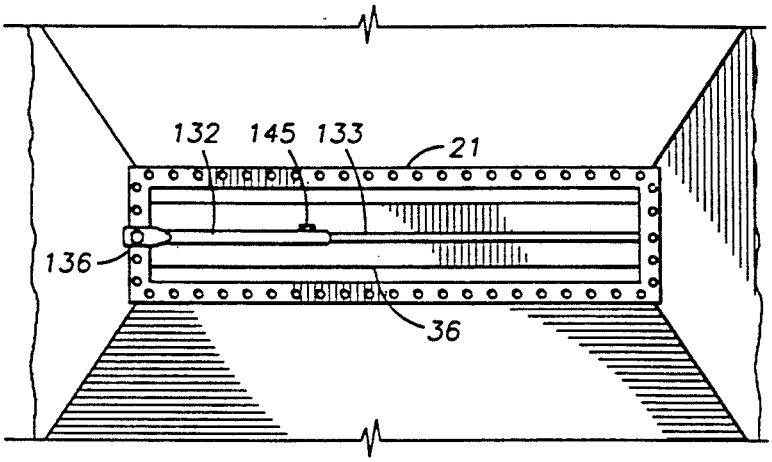
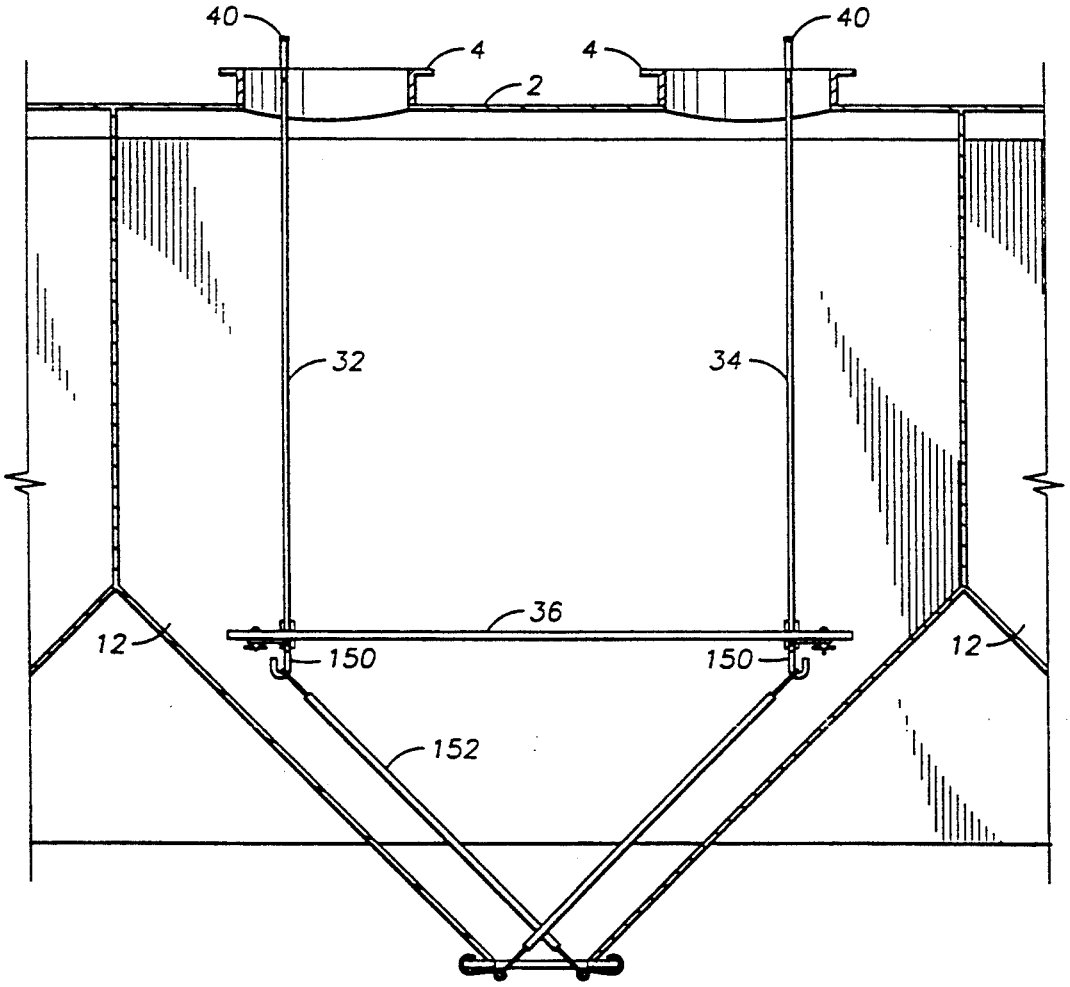
FIG. 11

SCAFFOLD SYSTEM

BACKGROUND OF THE INVENTION

This invention relates to the field of support systems used to position workmen and material adjacent work sites, more particularly to scaffolding systems used to position workmen and material during painting, cleaning and inspection of work surfaces, and more particularly still to scaffolding systems disposed within covered hopper railroad cars to allow workmen to paint, clean, cover and/or inspect the inner surfaces of the car.

Covered hopper cars are used in railroad operations to haul bulk cargos of goods which must be isolated from the elements. A substantial variety of goods are transported in these railroad cars, including agricultural products such as grains and sugar, and raw manufacturing materials, such as plastic pellets.

A typical covered hopper car is comprised of a hopper body subdivided into subcompartments, and a roof overlying the entire body. The body rides on a pair of trucks which are coupled to other cars in the train. Access into the interior of the covered hopper car is made through a plurality of manholes on the roof of the car, and through a series of valves, or gates at the bottom of the car. The car is loaded by opening the manholes, and pouring in the grain, plastic pellets, or other material. Once the compartment is filled, the manhole is closed. When the hopper car arrives at its destination, the valves, or gates at the bottom of the car are opened and the material is allowed to spill out of the gates under the car. To protect the car, and the cargo, the interior surface of the car is painted, or coated with a protective material.

One problem with covered hopper cars is the limited interchangability of the cars from hauling one type of cargo to another. For example, a car used in plastic pellet service cannot easily be converted to grain service, and vice versa. Changing the type of service requires cleaning, and sometimes repainting or recoating, the inside of the car. The remaining materials from the prior shipment could contaminate the different cargo, resulting in a loss. Additionally, many cargos are abrasive or reactive, and therefore abrade, erode or corrode the paint or protective coating on the interior surface of the hopper car. Likewise, as a result of normal wear and tear on the inner surfaces of the car, repainting is necessary at some time in the life of the car. As a result of these problems, the interior surfaces of the cars must be periodically washed, painted or recoated.

Cleaning, painting and resurfacing of the interior of the covered hopper car is a difficult proposition. The roof over the car limits the accessibility for workmen and material, so that any equipment and all workmen must fit through the upper manholes or bottom valves of the car. Typically, when the interior of the car is to be thoroughly cleaned or repainted, boards are dropped through the man holes or pushed up through the bottom valve and then placed across the individual compartments of the hopper. The boards are then supported on the side walls of the compartment while the cleaning or painting is accomplished. Scaffolding may be used within the hopper to support the boards. When scaffolding is used, the bases of the scaffold poles ride on the inner surface of the car. This is unacceptable, because the board ends create dirty spots or paintless voids on the side walls of the hopper.

Cleaning, painting, coating or inspecting railroad cars is a time-consuming process. However, every hour or day the car is out of service costs the car owner, or the carrier, money in the form of lost profits, rents or tariffs. It should be appreciated that if it takes a day, for example, to perform yearly car maintenance, and the car owner owns 365 cars, he needs an extra car to ensure that he has 365 in service every day while one is being serviced. As car service is not performed every day, and many car owners or railroads have thousands of cars, the time a car is offline and in service can seriously effect the capital investment required by the car owner to maintain the required fleet size.

When a hopper car is taken out of service, it is inspected, its running gear and undercarriage inspected, repaired and the inside is inspected and cleaned or painted. Once a decision is made to repaint the car, it is sandblasted and washed, primed and then painted. This process is accomplished on an "assembly line" basis, where cars are shunted down a track to sequential work stations. To sandblast the car, scaffolding is put in the car, and then the blasting is performed. However, the scaffolding is typically removed between each step of the repainting process because the scaffolding will shift and scratch or mar the inside surface of the car. This requires frequent assembly and disassembly of the scaffolding.

SUMMARY OF THE INVENTION

The present invention includes a pair of ladders suspended from opposed manholes located over a single compartment in a covered hopper car to form a scaffold, and a group of scaffold planks disposed between, and supported off of the floor of the hopper car by, the ladders. A stabilizing strap is included to minimize movement of the ladders and boards when workmen and equipment are loaded thereon.

Each ladder is constructed to include locking ears which engage the sides of the manhole, and a chain which interlocks the ladder to support elements on the cover or roof of the hopper. The lower portion of each ladder includes a pair of folding plank support bars on which a pair of planks are supported on either side of the ladder. A third plank is supported on a bar disposed between the side rails of the ladder itself. The ladder, and each of the support bars, include bosses onto which a stabilizing bar may be located.

To use the scaffolding system, ladders are hung in opposed manholes, and the support bars are folded outward. Planks are then pushed up through the bottom gates and placed on the support bars. Stabilizing bars are then bolted onto the tabs and into engagement with the valve body. To remove the scaffold, the steps are reversed.

The improved scaffold of the present invention overcomes the problems of the prior art by isolating the components from the sides of the car body, thereby reducing the likelihood of scratching the painted, coated or cleaned areas. Further, the components of the scaffold are supported off of the interior portions of the car except one part of the valve, reducing or eliminating areas which are hard to clean or paint. Finally, the scaffold may be left in the car while the car is moved, thereby eliminating teardown and rebuilding of the scaffolding during each repainting step. These and other advantages of the invention will be apparent from the Brief Description of the Preferred Embodiment, when read in conjunction with the following drawings:

BRIEF DESCRIPTION OF THE DRAWINGS

FIG. 6 is a partial view, partially in cutaway of the scaffold system of FIG. 2, showing the structure of the support ears;

FIG. 8 is a partial sectional side view of the hopper car of FIG. 1, showing the scaffold system secured within the car;

FIG. 9 is a partial bottom view of the hopper car of FIG. 9;

FIG. 11 is a sectional side view of a hopper car showing an alternative stabilizing system for the scaffold system.

BRIEF DESCRIPTION OF THE PREFERRED EMBODIMENT

Figure 1:
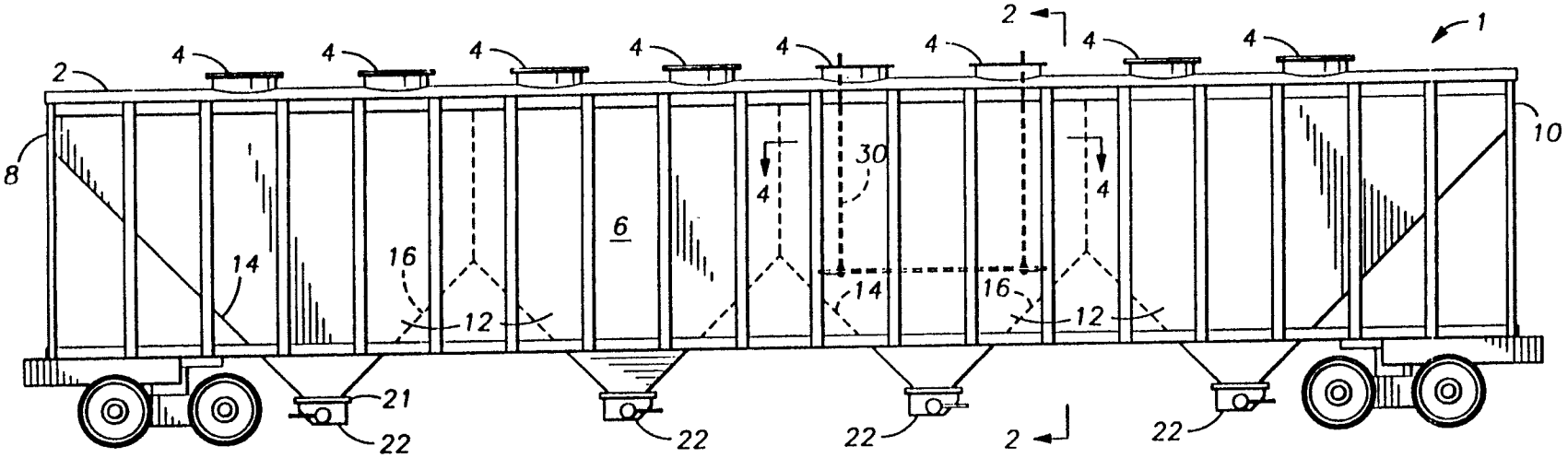
FIG. 1 is a side view of a hopper car including the scaffold of the present invention shown in phantom disposed within a car compartment.
Figure 7:
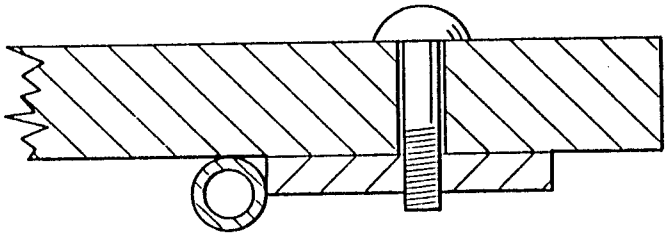
FIG. 7 is a detailed view of the scaffold system of FIG. 2 showing the attachment of the plank, to the plank stabilizing bars.
Figure 5:
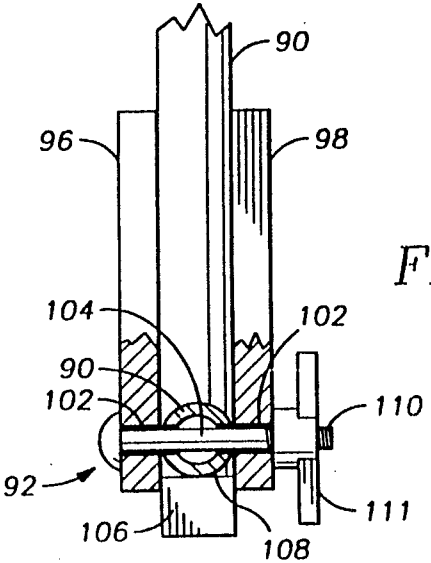
FIG. 5 is a partial side view of the scaffold system of FIG. 3, after assembly, showing the attachment means for the stabilizing bars.
Figure 2:
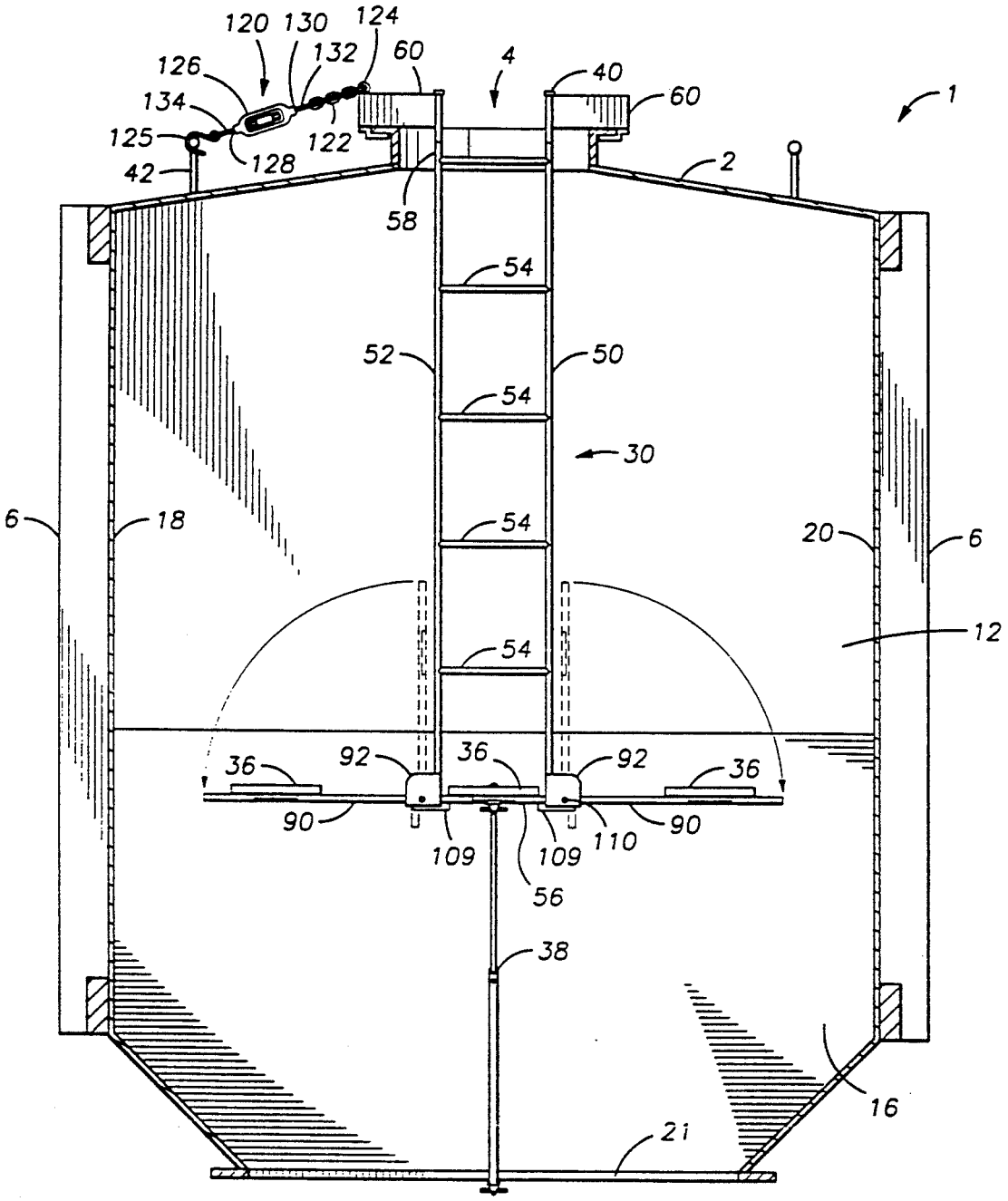
FIG. 2 is a sectional view of the hopper car of FIG. 1 at 2—2 showing the scaffold system of the present invention.
Figure 4:
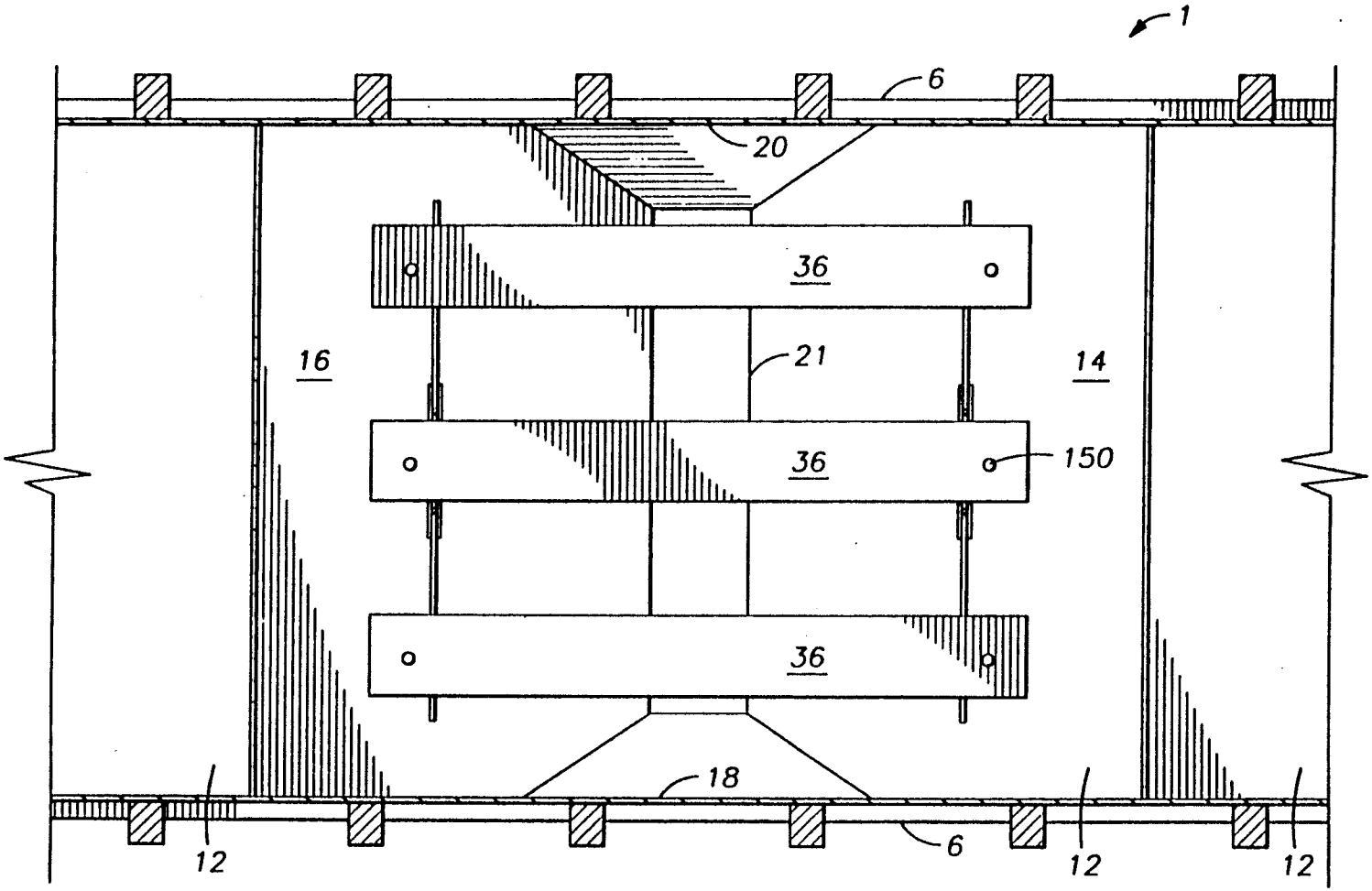
FIG. 4 is a sectional view of the hopper car of FIG. 1 at Section 4—4.

Referring generally to FIGS. 1, 2, and 4, covered hopper car 1 is shown in cutaway. Covered hopper car 1 includes a roof 2 having man holes or ports 4 therein, sidewalls 6 and end walls 8, 10. The interior portion of covered hopper car 1 is subdivided into individual segments, or compartments 12. Each of compartments 12 includes articulated end walls 14 and 16, and opposed side walls 18 and 20. The bottom of each compartment 12 terminates in a valve, or gate 22, attached to a gate flange 21, which may be selectively opened to dump the contents of compartment 12.

Scaffold 30 is suspended within compartment 12, and includes ladders 32 and 34, each suspended from a separate manhole 4, and a plurality of boards or planks 36 disposed therebetween. A stabilizing bar 38 is interconnected from scaffold 30 to valve flange 21 to stabilize scaffold within hopper car 1.

Referring now to FIGS. 2 to 7, the details of ladder 32 are shown. Ladders 32 and 34 are interchangeable, and only the details of ladder 32 need be discussed in detail. It will be appreciated that the detailed features of ladder 32 are also found in ladder 34, except where noted. Ladder 32 includes a pair of opposed tubular side rails, 50, 52, interconnected by a plurality of tubular rungs 54 and plank support rung 56. Rails 50, 52, rungs 54 and plank support rung 56 are preferably manufactured from extra heavy, or schedule 8 aluminum pipe. Rungs 54 and plank support rung 56 are preferably cut into ten inch lengths from $\frac{3}{4}$ inch tubular stock, and the opposed ends thereof are welded to rails 52, 54. Rails 52 and 54 are preferable six foot, six inch lengths of one inch tubular aluminum stock. Rung 56 is welded onto rails 50, 52 to form the lower end 33 of ladder 32. The remaining five rungs 54 are likewise welded at their ends to rails 50 and 52, and are staggered from rail 56 to form steps or rungs of a ladder. Each of rungs 54 are spaced approximately fifteen to sixteen inches apart on rails 52, 54, and the lowest of rungs 54 is disposed approximately fifteen to sixteen inches from plank support rail 56.

Referring now to FIGS. 2 and 6, the ladder support system 40 is shown. To support or hang ladders 32, 34 from manholes 4, the upper end 58 of ladder 32 includes a pair of ears 60, one of each disposed at the terminus of rails 50, 52. Each of ears 60 includes a six inch length of one inch diameter schedule 8 aluminum pipe 62, and a rectangular tab portion 64 welded thereto along the length of the outside diameter thereof. A hook portion 66 is welded to the lower face of tab 64. Hook portion 66 is preferably a single length of half inch square aluminum, and is offset to include a welding flat 70, a first bend portion 72 disposed approximately 90 degrees thereto, and a second retainer portion 74 offset approximately 90 degrees from the first bend portion 72 and substantially parallel to the welding flat 70. Welding flat 70 is welded to the lower portion of tab 64, and first bend portion 72 is sized and disposed such that a gap of approximately one half inch is located between retainer portion 74 and the lower portion of tab 64. One of tabs 64 includes a threaded hole 80 in the upper portion thereof.

Ears 60 are positioned on rails 50, 52 to permit pipe 62 to rotate with respect to the rail 50 or 52. To retain ears 60 on rails 52, 54 and permit rotation thereof, a rod 82 is inserted inward the upper end 84 of each rail 52, 54, and welded thereto. Rod 82 is preferably a twelve inch long $\frac{7}{8}$ inch diameter rod, and is inserted approximately five inches into end 84. Pipe 62 is then placed over rod 82, and a cap washer 86 is welded to the end 85 of rod 82 protruding through pipe 62 which retains ears 60 on rails 52, 54. Ear 60 is thus rotatable but retained on rail 50 or 52.

Referring now to FIGS. 2, 3, 4, 5, and 7, the construction of the ladders and planks is shown. To support planks 36 in car 1, ladders 30, 32 each include plank rung 56 and opposed retractable plank support arms 90 at the lower end thereof. To support arms 90 on ladder 32, channel pinch hinges 92 are disposed on the lower end of ladder 32, on rails 52, 50 opposite ladder support rung 56. Hinges 92 include a pair of rectangular pinch plates 96, 98, welded at a first edge 100 thereof to rail 52 and projecting outward therefrom in substantially parallel relationship to each other directly opposite from support rung 56. Each pinch plate 96, 98 includes a pin hole 102 disposed therethrough, and pin holes 102 a collinear. To help prevent injury, the upper outer corner of each plate 96, 98 is rounded.

Plank support arm 90 is a tubular member, preferably a twenty inch length of one inch diameter schedule 8 aluminum pipe. A mating hole 104 is disposed through one end thereof, across the diameter. Plate 106 is also welded to arm 90, adjacent hole 102, and approximately ninety degrees therefrom on the outer diameter thereof. Plate 106 is disposed on arm 90 such that a portion thereof, preferably one half of its length, projects outward beyond arm end 108 forming overhanging portion 109. End 108 is disposed between plates 96, 98, and a bolt 110 is located through pinholes 102 and mating hole 104. A wingnut 111 is secured over the protruding end of bolt 110 to retain bolt 110 in place. Plates 96, 98 are located on rail 52 such that the diameter of arm 90 is slightly larger than the spacing between plates 96, 98.

Figure 3:
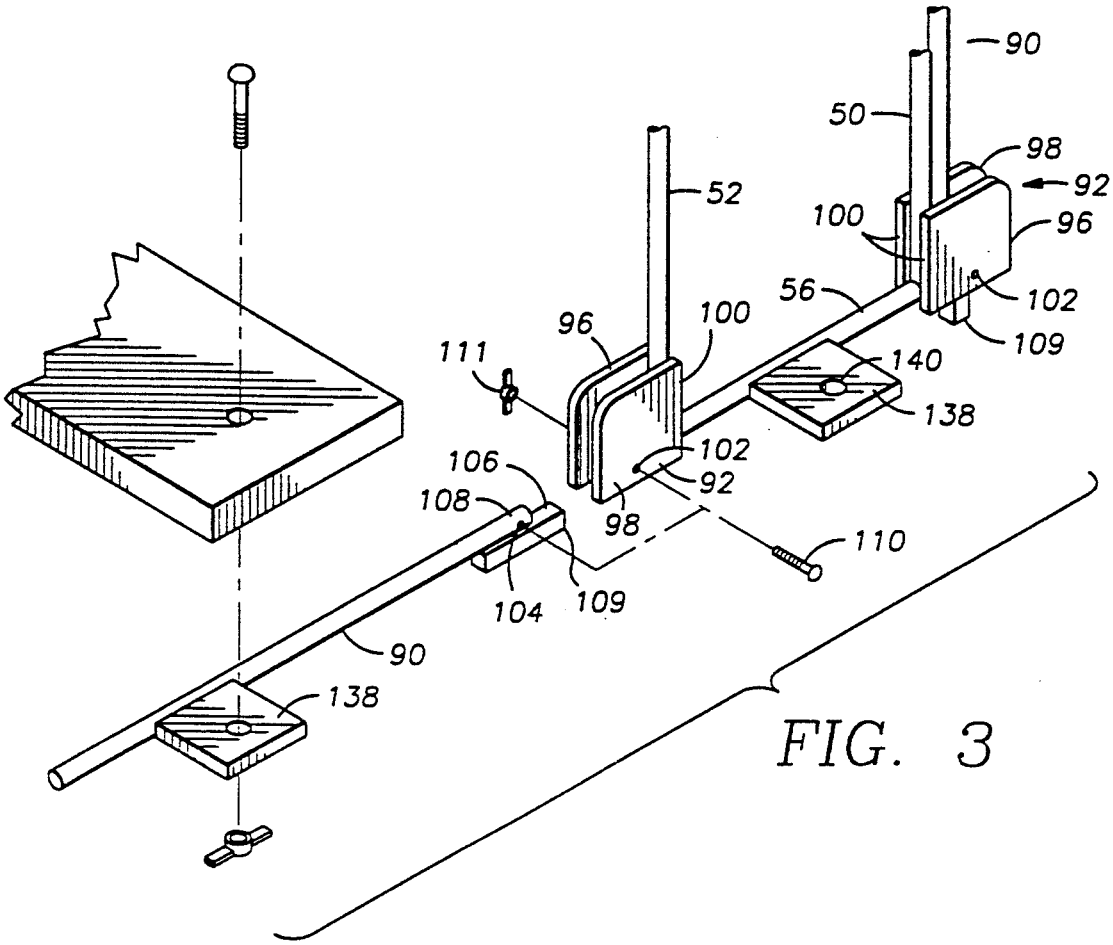
FIG. 3 is a partial view of the scaffold system of FIG. 2, showing the detail of the plank support bars.

Arm 90 is locateable in two positions as shown in FIGS. 2 and 3. When arm is rotated up against rail 52, as shown adjacent rail 50 in FIG. 3 and in phantom in FIG. 2, the friction between plates 96, 98 and arm 90 will maintain arm 90 in place. When arm 90 is bent downward, overriding portion 109 of plate 104 contacts the bottom of plate support rung 56 when arm 90 is disposed approximately ninety degrees to rail 56, supporting arm 90 against further rotational motion about bolt 110 as shown in FIG. 3.

Referring again to FIG. 6, tab 60 on rail 50 includes tab stabilizing guide 120 thereon which is attached to a bar or rail 42 on the top of car 1 to stabilize the upper end of ladder 30 in manhole 4. Guide 120 includes a chain 122 terminating in an eyelet 124, an S-hook 125, and a turnbuckle 126 disposed therebetween. Turnbuckle 126 includes a body having opposed threaded holes 128, 130, and threaded hooks 132, 134 received in holes 128, 130. Eyelet 132 is hooked to one end of chain 122, and the other end of chain 122 is threaded into hole 80 by eyelet 122. S-hook 125 is hooked to eyelet 134, and is secured to a rail on the roof 2 of car 1.

Figure 10:
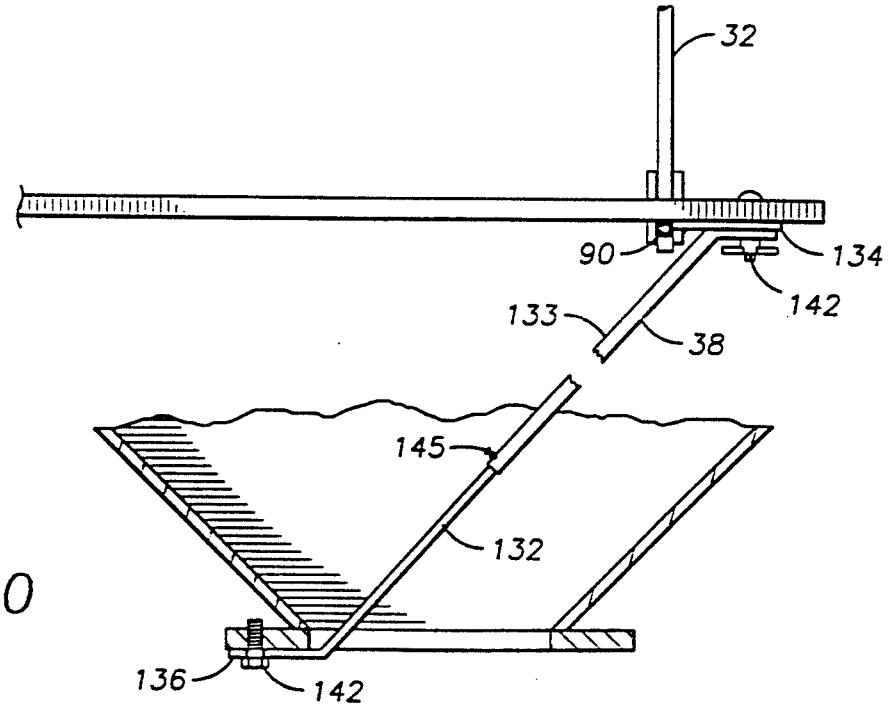
FIG. 10 is a partial view of the partial side view of the hopper car of FIG. 8.

Referring now to FIGS. 2, 8, and 10, stabilizing bar 38 is located below scaffold 30 to secure scaffold 32 to valve flange 130. Bar 38 includes two interconnected tubular members 132, 133 and a bolt 145. Tubular member 132 is preferably one inch diameter schedule 8 pipe, and member 133 is a length of ¾ inch schedule 8 pipe telescoped therein. A dogleg portion 134, 136 is disposed at the free end of member 132, and dogleg 136 is disposed at the free end of member 133. To lock members 132 and 133 together, one of members 132 or 133 has a plurality of holes therethrough, and the remaining member of 132 or 133 has a single alignment hole therein. When arm 38 is properly telescoped, a pin is placed through an alignment of holes to secure arm 38 against further telescoping. Alternatively, member 132 may include a through threaded hole therein in which a set screw 145 is located. When members 132, 133 are properly positioned, screw 145 is turned to lock them in place.

To attach stabilizing bar 38 to scaffold 30, plank rung 56 includes a flange 138 welded thereto, having a hole 140 therethrough. Likewise, each dogleg 134, 136 includes a dogleg hole 142 therethrough. To stabilize scaffold 30 within compartment 12, a nut 150 and wingnut are fastened through hole 142 in upper dogleg 134 and through plank 36, and a bolt is passed through hole 142 in lower dogleg and threaded into a hole in valve flange 21.

To locate scaffold 30 into car 1, two manholes in compartment 12 are opened, and valve 22 is removed from valve flange 21 by unscrewing bolts securing it thereto, leaving the bottom of valve flange 21 exposed. Ladders 32, 34 are then lowered into each manhole, such that tabs 64 overhang the side thereof. Tabs 64 are rotated over the top of each manhole such that second retainer portion 74 is disposed below an overhanging lip 71 on manhole. Bending out each tab 64 thus locks ladders 32, 34 into place in manhole 4. To further secure ladder, S-hook 125 is attached over a rail 42 or other secured portion on roof 2, and turnbuckle 126 is turned until chain 122 is taught. The installer then climbs down ladder 32 or 34, and pushes support arms 90 outward until they are disposed substantially perpendicular to rails 54, 56 and then climbs up the ladder and out of manhole 4. The installer then enters the bottom of compartment 12 through valve flange 21, and attaches a stabilizing bar 38 to one of pads 138 on ladder 32 or 32. At this point, planks 36 are pushed up through gate 22, and disposed across plank supports 56 or arms 90 of opposed ladders 32 or 34. Planks are bolted to arms 90 once dogleg portions 134, 136 are secured in place, bolt 145 is passed the through an alignment of holes to lock bar 38 in place. Bar 38 is then bolted to flange 21. When scaffold 30 must be removed, the procedure is reversed.

Referring now to FIG. 11, an alternative embodiment of the invention is shown. In this embodiment, a hook 150 is welded to the underside of plank rung 56 of ladders 32, 34. After planks 36 are located in place on ladders 32, 34 and arms 90, a tension cord 152 is attached to one of hooks 150, and the other end is passed under a bar disposed across valve flange 22, and then hooked to the other hook 150.

The use of ladders 32, 34 supporting planks 36, where the components are suspended from the manholes 4 of the car allows for complete cleaning of the inside of the hopper car without leaving voids and reduces the incidence of scratching the newly cleaned, primed or painted surface as the car is moved or the scaffolding is removed.

I claim:

1. A scaffolding system for supporting workers or materials within a covered hopper car having multiple portholes through the cover thereof, comprising;

a suspension member for suspending workers or materials from the cover portion of the covered hopper car, said suspension member being insertable and removable from the interior of the covered hopper car;

a support member for supporting workers or materials used on the inside of the covered hopper car and suspended in the covered hopper car by said suspension member;

a stabilizing member for stabilizing said support member within the confines of the covered hopper car;

said suspension member including a hanging portion suspended from the cover portion having at least one moveable support arm disposed thereon, said support arm having a first position and a second position with respect to said hanging portion, said support arm being disposed in said first position during insertion of said hanging portion inward the hopper car and in said second position for receiving said support member, said support arm having a free end, an opposed support end, and an intermediate connection point, said support arm interconnected to said hanging portion at said connection point, such that in said second position, said support arm is supported on said hanging portion by said support end which is in that position disposed opposite said hanging portion from said free end; and said suspension member further including a support arm reaction member thereon to interact with said support end to support said support arm in said second position.

2. The scaffolding system of claim 1, wherein said suspension means is at least two ladders received in the interior of the hopper car through different cover portholes.

3. The scaffolding system of claim 2, wherein said ladders include a stabilizing means attachment member, and said stabilizing means interconnects at least one of said ladders to the lower portion of the outside of the car.

4. The scaffolding system of claim 1, wherein said suspension means includes a rotatable support bar which engages over the edge of the porthole to support said suspension means within the hopper car.

5. The scaffolding system of claim 2, wherein said ladders include a lower end portion and at least one support member is articulately attached to each of said ladders at said lower end portion thereof.

6. The scaffolding system of claim 5, wherein said lower end portion includes a hinge connection means, and said intermediate connection point is received in said hinge connection means.

7. The scaffolding system of claim 6, wherein said hinge connection means includes a pair of opposed plates which are sized to interferingly receive said intermediate connection point therein.

8. The scaffolding system of claim 7, wherein said plates retain said support member in said first position.

9. A scaffolding system for use in confined spaces having limited access through at least a pair of upper hatches and a lower gate, wherein the scaffold may be supported in the space without resting upon the inner walls or surfaces thereof, comprising;

first and second ladders having an upper fastening means for detachable attachment to the hatch and a lower carrying means disposed inward the space from the hatch;

said carrying means including at least one hinged support arm located thereon, said support arm having a hinged end articulatably connected to said carrying means and a second free end which may be moved with relation to said carrying means;

said arm having a first position whereby it is folded to permit insertion of said ladder into the hatch and a second position whereby said second end is moved to a position away from said ladder; and a plank disposable across said support arms of said first and second ladders.

10. The scaffold system of claim 9, wherein said upper fastening means includes a pair of positionable interference members which may be positioned to overlay the top of the hatch and thereby support the ladder in the hatch.

11. The scaffold system of claim 9, wherein the bottom rung of each ladder is sized to permit the placement of a plank thereon to a support said plank between said bottom rungs on said first and second ladders.

12. The scaffold system of claim 9, wherein said first ladder further includes a stabilizing bar connected to said lower carrying means and an area adjacent the lower gate.

13. The scaffold system of claim 9, wherein said support bar is comprised of multiple pieces and at least one portion thereof is telescopically received in a second portion thereof.

14. The scaffold system of claim 9, wherein said arm hinged end is interconnected to said lower carrying means by a pin connection.

15. The scaffold system of claim 14, wherein said pin connection includes a pair of opposed pinch plates, and said first end of said support bar is disposed between said pinch plates.

16. The scaffold system of claim 15, wherein said pinch plates are disposed apart to interferingly receive arm first end therein and permit movement of arm second end with respect thereto.

* * * * *